US009103631B2

(12) United States Patent
Evans

(10) Patent No.: US 9,103,631 B2
(45) Date of Patent: Aug. 11, 2015

(54) SIGHT FOR AN ARCHERY BOW

(71) Applicant: Trophy Taker, Inc., Plains, MT (US)

(72) Inventor: Daniel L. Evans, Trout Creek, MT (US)

(73) Assignee: Trophy Taker, Inc., Plains, MT (US)

( * ) Notice: Subject to any disclaimer, the term of this patent is extended or adjusted under 35 U.S.C. 154(b) by 207 days.

(21) Appl. No.: 13/849,137

(22) Filed: Mar. 22, 2013

(65) Prior Publication Data

US 2013/0247399 A1 Sep. 26, 2013

Related U.S. Application Data

(60) Provisional application No. 61/614,273, filed on Mar. 22, 2012.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 3,163,937 A * 1/1965 Reynolds ..... 33/265
3,310,875 A * 3/1967 Kowalski ..... 33/265
3,579,839 A * 5/1971 Kowalski ..... 33/265
3,798,783 A * 3/1974 Carella ..... 33/265
3,822,479 A * 7/1974 Kowalski ..... 33/265
4,162,579 A * 7/1979 James ..... 33/265
4,414,751 A * 11/1983 Mathews ..... 33/265
4,543,728 A * 10/1985 Kowalski ..... 33/265
4,584,777 A * 4/1986 Saunders ..... 33/265
4,846,141 A 7/1989 Johnson
4,910,874 A * 3/1990 Busch ..... 33/265
5,103,568 A 4/1992 Canoy
5,406,712 A 4/1995 Slates
5,419,051 A 5/1995 Barngrover
5,421,315 A * 6/1995 Miller ..... 124/87
5,560,113 A 10/1996 Simo et al.
D378,846 S 4/1997 Sodaro
5,630,279 A 5/1997 Slates
6,000,141 A 12/1999 Afshari
6,418,633 B1 7/2002 Rager
D487,789 S 3/2004 Rager
D489,427 S 5/2004 Rager
D505,477 S 5/2005 Rager
D528,183 S 9/2006 Evans
D530,773 S 10/2006 Evans
7,275,328 B1 * 10/2007 Rager ..... 33/265
7,278,216 B2 10/2007 Grace
7,331,112 B2 2/2008 Gibbs
7,401,411 B2 7/2008 White
7,574,810 B1 8/2009 LoRocco (Continued)

OTHER PUBLICATIONS

Cabela's Archery 2004 Catalog, pp. 3 and 60-68, 11 pages.

*Primary Examiner* — Christopher Fulton
(74) *Attorney, Agent, or Firm* — Sheridan Ross P.C.

(57) ABSTRACT

An archery sight for a bow is provided. The sight provides at least one sight pin that is adjustable, such as a sliding pin adjustable in a vertical direction, and a plurality of fixed sight pins. The plurality of sight pins are repositionable such that they may either be placed in alignment with the adjustable sight pin or moved out of the way so as avoid obstructing an archer's target or vision.

18 Claims, 7 Drawing Sheets

(56) References Cited

U.S. PATENT DOCUMENTS

| | | | | |
|---|---|---|---|---|
| 2002/0042999 | A1 | 4/2002 | Lorocco | |
| 2003/0110647 | A1 | 6/2003 | Henry | |
| 2003/0110648 | A1 | 6/2003 | Springer | |
| 2004/0088872 | A1 | 5/2004 | Deien | |
| 2007/0220761 | A1 * | 9/2007 | Helm et al. | 33/265 |

* cited by examiner

SIGHT FOR AN ARCHERY BOW

This Non-Provisional Application claims the benefit of priority from U.S. Provisional Patent Application No. 61/614,273 filed Mar. 22, 2012, the entire disclosure of which is incorporated by reference in its entirety herein.

FIELD OF THE INVENTION

The present invention relates generally to archery sights. More specifically, the present invention relates to an archery sight with at least one adjustable sight pin and a plurality of fixed sight pins.

BACKGROUND

There currently exist various sighting devices for aiding a user of an archery bow when attempting to strike a given target with an arrow. Examples of such devices include: U.S. Pat. No. 7,574,810 to LoRocco, U.S. Pat. No. 7,331,112 to Gibbs, U.S. Pat. No. 7,278,216 to Grace, U.S. Pat. No. 5,630,279 to Slates, U.S. Pat. No. 7,401,411 to White, and U.S. Pat. No. 4,846,141 to Johnson, all of which are incorporated by reference herein in their entireties.

SUMMARY OF THE INVENTION

The present invention contemplates a novel system, device, and methods for an archery sight comprising at least one adjustable pin and at least one fixed pin.

In one embodiment, an archery sight for interconnection with a bow is provided, the archery sight comprising a first substantially rigid member comprising a first sighting pin, the first sighting pin being selectively positionable by a user in at least a vertical direction, a second member comprising a plurality of sighting pins, the plurality of sighting pins being substantially fixed in a vertical position and adjustable with respect to each other, and the second member interconnected to the first substantially rigid member, the first substantially rigid member and the second member being selectively positionable with respect to one another between a first position and a second position. Both the first sighting pin and plurality of sighting pins may also be adjustable in a horizontal plane to adjust for windage as necessary.

The present disclosure contemplates a wide variety of means for securing a portion of a sight in various positions. For example, various magnetic securing members, clasps, hooks, shelves, vertical supports, pins and similar features are contemplated.

As referred to herein, bow sights may comprise any number of known devices including, but not limited to, pin sights, dot sights, fiber optic sights, and various other known archery sights as will be recognized by one of skill in the art and comprising at least one sighting pin.

In one embodiment, a method of adjusting an archery sight for a bow is provided, the archery sight comprising a first pin adjustable in a vertical direction and a plurality of substantially fixed pins, the method comprising determining a corresponding distance of travel of a projectile for at least one of the plurality of substantially fixed pins by targeting an object at a known distance (e.g. a shooting range target), and based on the determined corresponding distance of travel for the projectile for the at least one substantially fixed pin, selectively adjusting the first pin with respect to the at least one of plurality of substantially fixed pins such that the first pin corresponds to a second distance, and selectively and substantially removing the plurality of substantially fixed pins from an archer's line of sight, such that the archer may then target and shoot objects with a minimal amount of sight pins in the archer's vision.

In certain embodiments, one or more sight pins are provided as projected or virtual sight pins. For example, a plurality of electronic sight pins may be provided on a sighting or viewing screen. Such a screen is rotatable or removable from view, at least in embodiments where the virtual pins comprise the "fixed" sight pins disclosed herein. In various embodiments, secondary sighting pins may be vertically adjustable with respect to one another, and adapted to be moved, pivoted, swung, translated, etc. out of a field of view, thus leaving only a single primary adjustable sight pin in a user's field of view.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
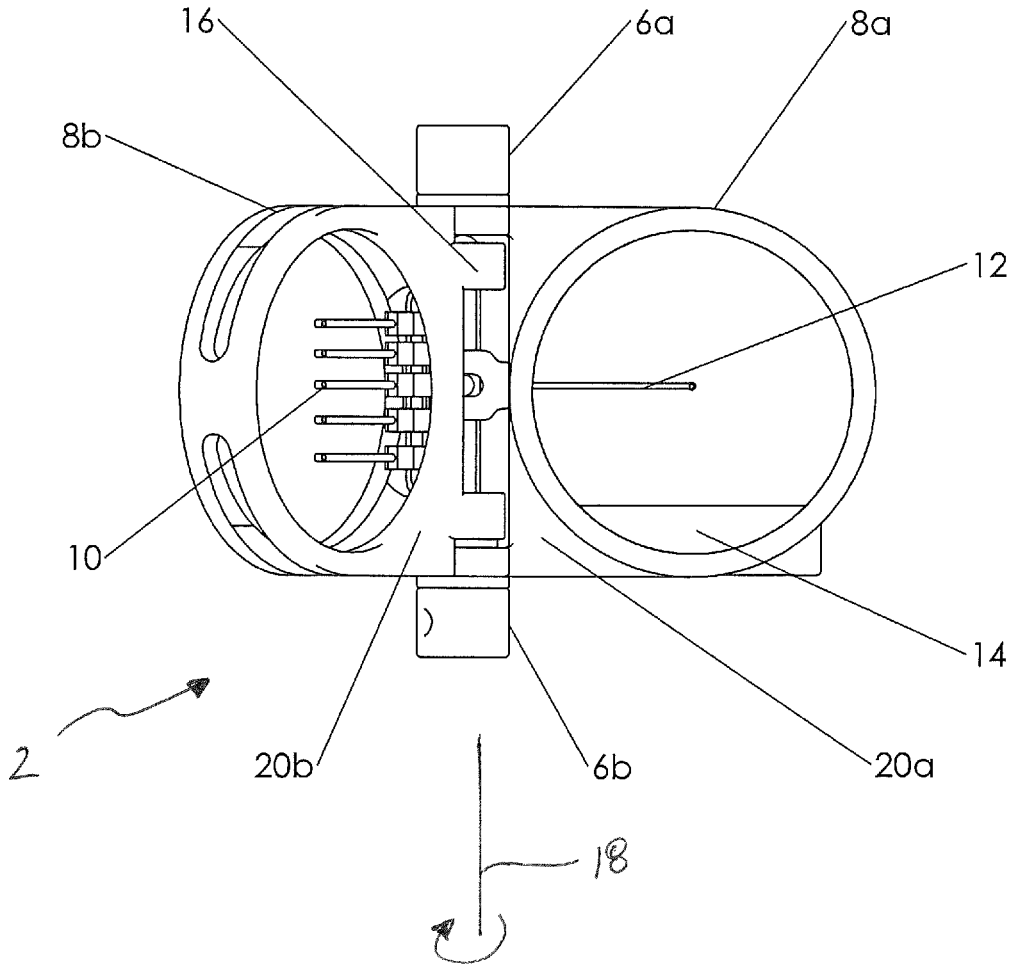
Figure 2:
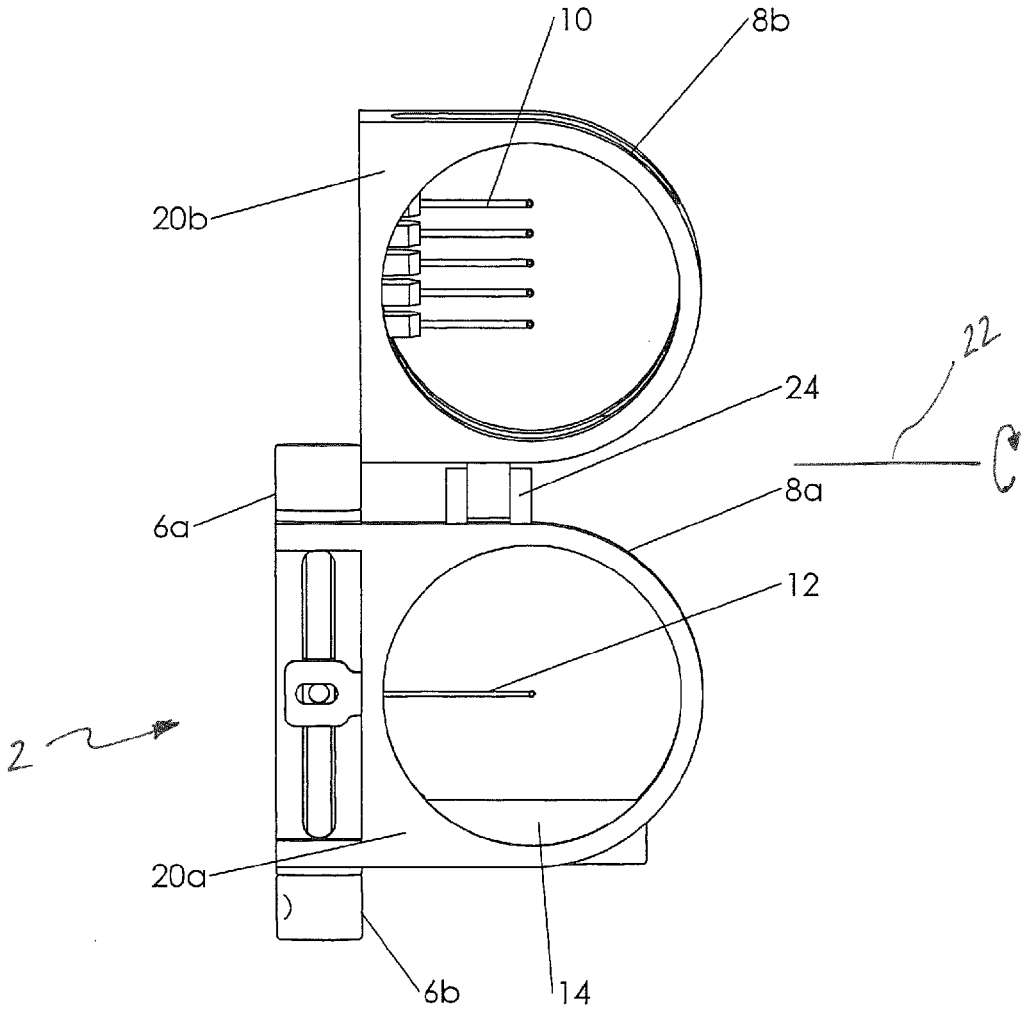
Figure 3:
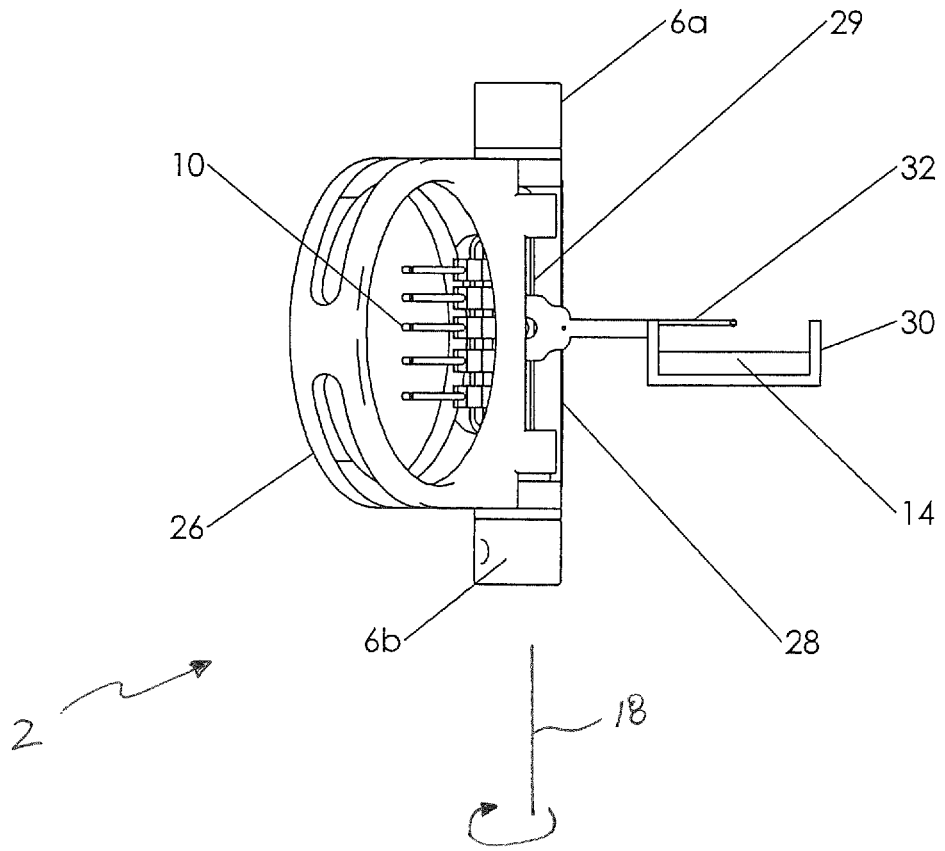
Figure 4:
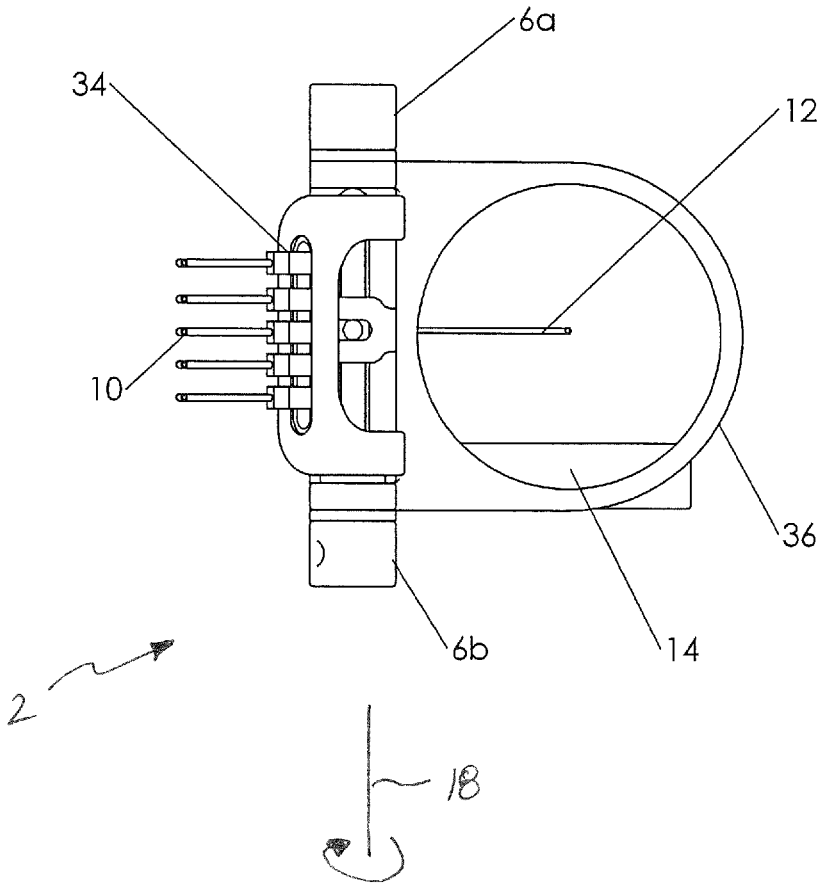
Figure 5:
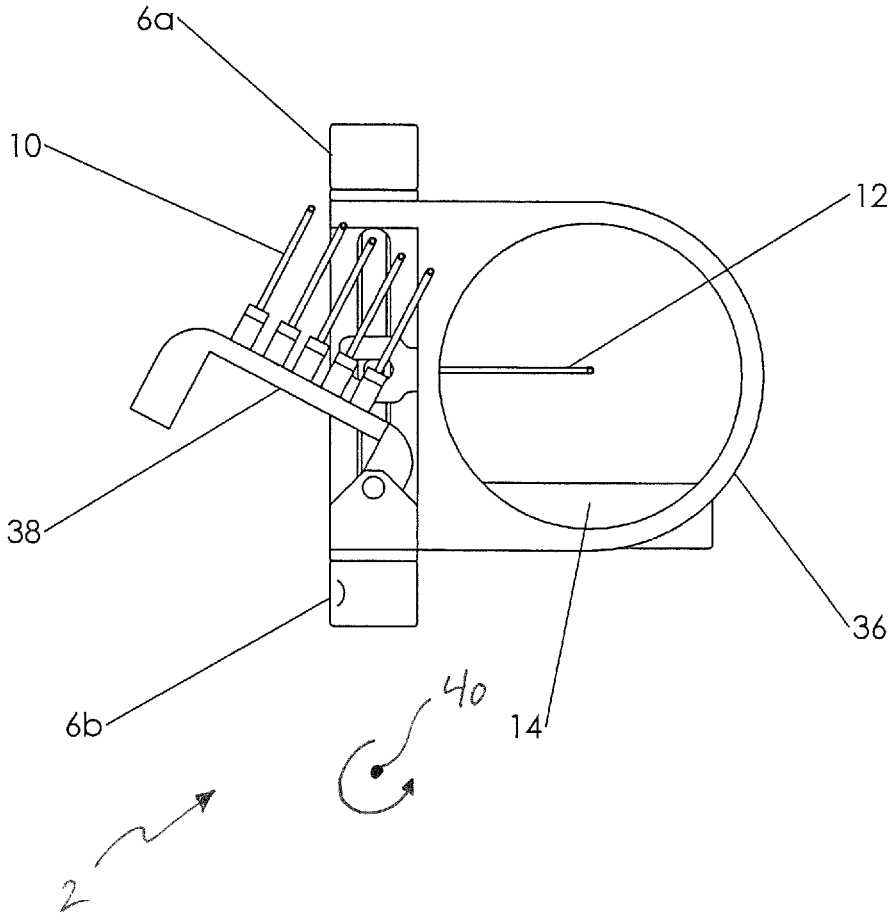
Figure 6:
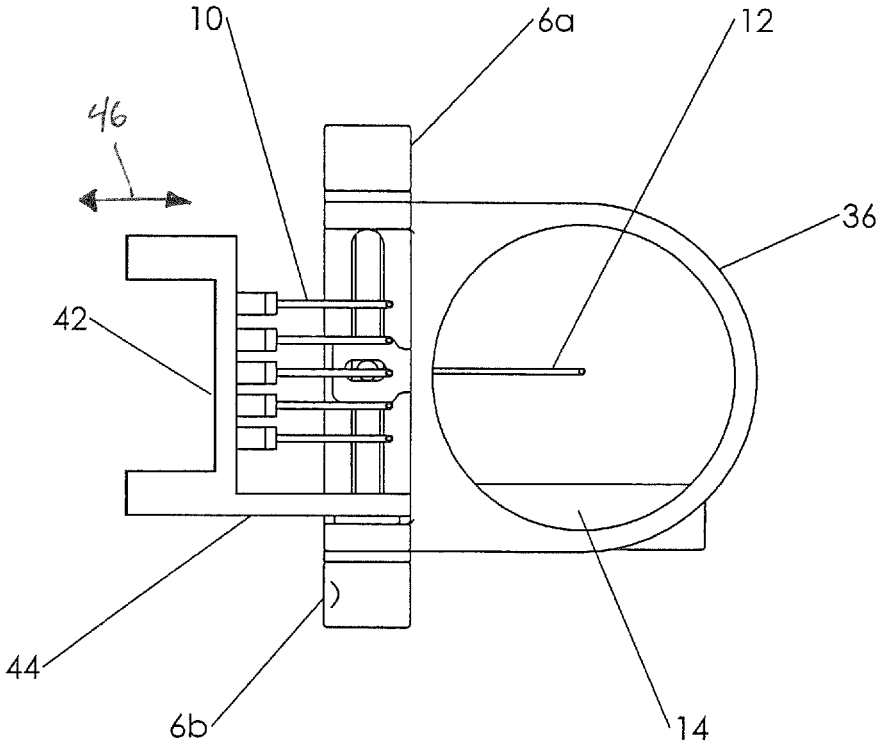
Figure 7:
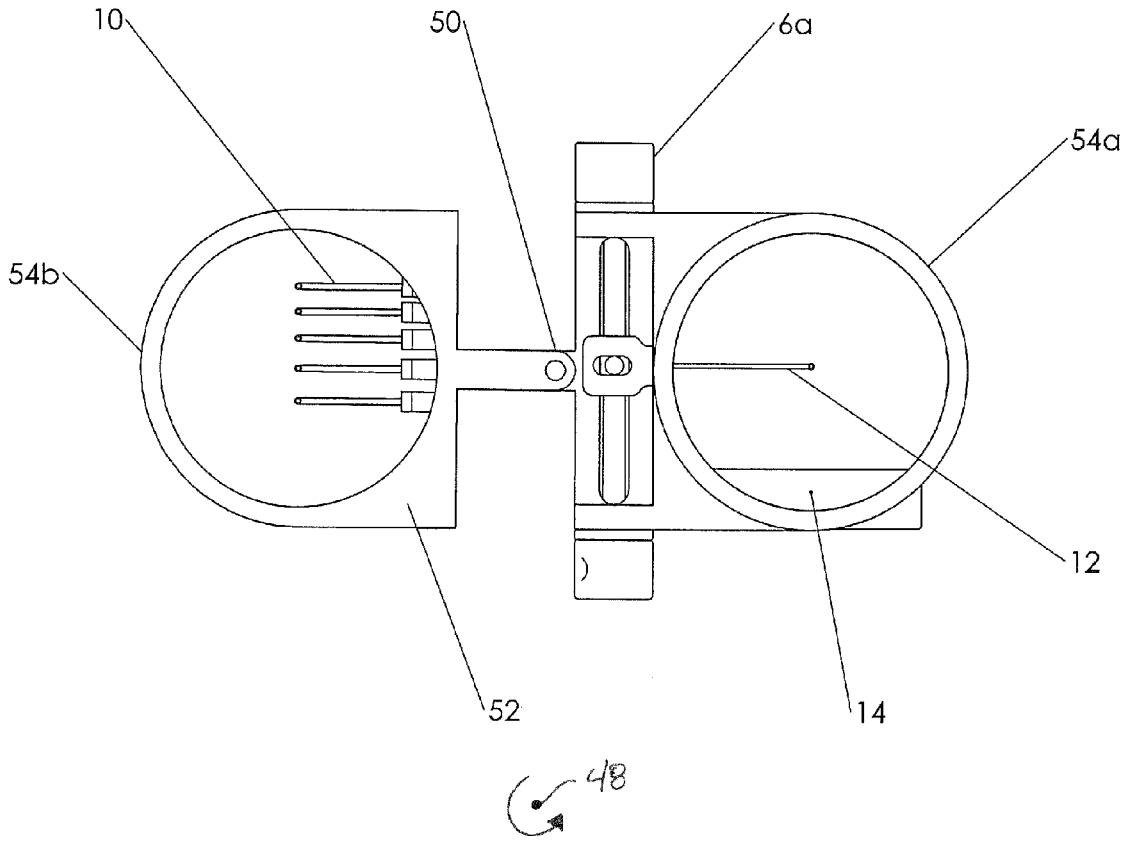

FIG. 1 is an elevation view of an adjustable archery sight according to one embodiment of the present disclosure;

FIG. 2 is an elevation view of an adjustable archery sight according to one embodiment of the present disclosure;

FIG. 3 is an elevation view of an adjustable archery sight according to one embodiment of the present disclosure;

FIG. 4 is an elevation view of an adjustable archery sight according to one embodiment of the present disclosure;

FIG. 5 is an elevation view of an adjustable archery sight according to one embodiment of the present disclosure;

FIG. 6 is an elevation view of an adjustable archery sight according to one embodiment of the present disclosure; and FIG. 7 is an elevation view of an adjustable archery sight according to one embodiment of the present disclosure.

DETAILED DESCRIPTION

The present invention has significant benefits across a broad spectrum of endeavors. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention.

Referring now to FIGS. 1-7, an archery sight according to various embodiments of the present disclosure is shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

Referring now to FIG. 1, an embodiment of an archery sight 2 according to the present disclosure is shown. The archery sight 2 is mountable to any number of bows and/or bow risers. The sight comprises at least one rotational adjustment member 6*a*, 6*b* for vertical and horizontal adjustment and two frame portions 8*a*, 8*b*, at least one of the frame portions 8*a*, 8*b* being rotatable or otherwise moved out of an archer's line of sight to a target, with respect to the other frame portion or the bow. An adjustable sighting pin 12 is provided on one frame member 8*a* and a plurality of fixed sighting pins 10 are provided on another frame member 8*b*. Fixed sighting pins 10, as will be recognized by one of ordinary skill in the art, comprise substantially rigid elongate points, the vertical position of which correspond to a predetermined down-field range. A lower sighting pin 10 corresponds to a first travel distance of a projectile, where pins located vertically above that lower pin correspond to progressively shorter travel distances for a projectile. Horizontal or windage adjustments can also typically be made on the fixed sight pins as necessary.

Frame member 8*b* is rotatable with respect to first frame member 8*a* about a vertical axis of rotation 18. FIG. 1 depicts frame member 8*b* in a generally open position. When first 8*a* and second 8*b* frame members are placed in a closed position, internal surface portion 20*a* of first member 8*a* and internal surface member 20*b* of second member 8*b* will positioned proximal to one another in a substantially parallel manner. Portions of internal surfaces 20*a*, 20*b* may, but need not necessarily be, in direct contact with one another.

Thus, embodiments of the present disclosure contemplate an archery sight 2 with a plurality of fixed sight pins 10 and at least one adjustable sight pin 12, wherein the special relationship between the fixed pins 10 and the adjustable pin 12 is variable. One advantage of this advancement is that when the sight 2 is placed in a closed position, adjustable pin 12 may be moved with reference to the fixed pins 10 for a predetermined distance, as fixed pins 10 will be disposed generally parallel and proximal to the sight pin. Furthermore, when a user desires to remove the fixed pins 10 from a direct field of view, the second frame portion 8*b* and interconnected fixed pins 10 are moved out of view by rotation, completive removal (e.g. by magnets), moved transversely, or otherwise positioned out of a field of view.

Second frame member 8*b* may be at least partially secured to the first frame member 8*a* in a variety of ways. For example, at least portions of the frame members 8*a*, 8*b* may comprise magnetic properties whereby the members 8*a*, 8*b* are magnetically secured when provided in a closed position. Similarly, magnetic materials may be 145 provided to secure a second frame member 8*b* in an open position. For example, magnetic materials may be provided on the first 8*a* and/or second 8*b* members proximal hinges 16 and on a surface perpendicular to the internal surfaces 20*a*, 20*b*.

In various embodiments, one or more latches are provided to selectively connect the frame member portions 8*a*, 8*b*. Latches comprise, for example, spring latches, slam latches, cam locks, Norfolk latches, Suffolk latches, crossbars, cabin hooks and other latches as will be recognized by one of skill in the art.

In certain embodiments, one or more hinge members connecting portions of the sight comprise self-locking features, such as a toothed or ratcheted hinge capable of generally securing the position of the rotatable member at a plurality of relatively narrow-spaced intervals.

In various embodiments, magnetic features are provided on at least one frame member. In one embodiment, for example, a hinged member is magnetically fastenable to a stationary member with a sufficient magnetic force to prevent undesired swinging or opening of the hinged member, yet still allows a user to easily open and/or rotate the hinged member. Magnetic features may be employed to secure hinged features in open positions and closed positions.

The individual pins, in various embodiments, are pushed out of sight with a ball détente, thus obviating the need for a second frame portion.

Various additional features common to archery sights may be provided in combination with features of the present disclosure. For example, a bubble level 14 for leveling a bow in at least one axis is provided on at least one of the first 8*a* and second 8*b* frame members of the sight 2. As used herein, the term "vertical" generally refers to vertical with respect to the force vector of gravity, and relates to the position of a bow when aimed or held upright and angle at approximately 0 degrees with respect to a horizon.

FIG. 2 depicts an archery sight 2 according to one embodiment of the present disclosure. As shown in FIG. 2, an archery sight 2 is provided of similar construction to the sight shown and described in FIG. 1. The sight of FIG. 2, however, comprises a second frame portion 20*b* that is rotatable with respect to a first frame portion 20*a* about an axis 22 that is disposed substantially perpendicular to the axis 18 of FIG. 1. Thus, a portion of the sight 2 of FIG. 2 is hingedly rotated upwardly or downwardly in order to move a set of fixed pins 10 out of the line of sight of an archer. Portions of the sight 2 may be rotated about one or more hinges 24 and secured in any manner as shown and described herein. The second frame member 20*b* may be secured in an open position by a magnetic force between at least a portion of the frame member 20*b* and a portion of the bow riser or the bow.

FIG. 3 is an elevation view of one embodiment of the present disclosure. An archery sight 2 is provided with a rotatable frame member 26, the rotatable frame member 26 comprising a plurality of fixed sight pins 10. The frame member 26 is rotatable with respect to a fixed member 28 provided with a slot 29 defining a path of travel for an adjustable pin 32. The adjustable pin is positioned on an adjustable carriage 30, further comprising a bubble level 14. Fixed member 28 comprises a generally planar structure and is hingedly connected to rotatable member 26.

FIG. 4 is a front elevation view of another embodiment of the present disclosure. A sight 2 is provided for interconnection a bow or portion of a bow. The sight 2 comprises a substantially stationary member 36 comprising an adjustable sighting pin 12 that is translatable in at least a vertical direction. A hinged member 34 is hingedly connected to the member 36 and rotatable about a substantially vertical axis 18. The hinged member 34 comprises a plurality of sighting pins 10, the sighting pins being movable into and out of a line of sight further comprising the adjustable pin 12.

FIG. 5 is a front elevation view of another embodiment of the present disclosure. A sight 2 is provided for interconnection a bow or portion of a bow. The sight 2 comprises a substantially stationary member 36 comprising an adjustable sighting pin 12 that is translatable in at least a vertical direction. A hinged member 38 is hingedly connected to the member 36 and rotatable about a substantially horizontal axis 40. The hinged member 38 comprises a plurality of sighting pins 10, the sighting pins being movable into and out of a line of sight further comprising the adjustable pin 12.

FIG. 6 is a front elevation view of another embodiment of the present disclosure. A sight 2 is provided for interconnection a bow or portion of a bow. The sight 2 comprises a substantially stationary member 36 comprising an adjustable sighting pin 12 that is translatable in at least a vertical direction. A translatable carriage member 42 is connected to the member 36. In one embodiment, the carriage member 42 is translatable in a lateral direction 46 and along track 44, such that interconnected sighting pins 10 may be moved in and out of a combined line of sight with an adjustable pin 12. Although FIG. 6 depicts a carriage 42 that is translatable in a lateral direction 46, it will be expressly recognized that various features of the present disclosure may be provided as translatable in any number of directions including, for example, horizontal directions, vertical directions, and diagonal translations, about any number of axis or planes.

FIG. 7 is a front perspective view of another embodiment of the present disclosure. A sight 2 is provided for interconnection a bow or portion of a bow. The sight 2 comprises a first frame member 54*a* comprising an adjustable sighting pin 12 that is translatable in at least a vertical direction. A second frame member 54*b* is hingedly connected to the member 54*a* and rotatable about a substantially horizontal axis 48. The hinged member 54*b* comprises a plurality of fixed sighting pins 10, the sighting pins being movable into and out of a line of sight further comprising the adjustable pin 12. As shown, the second frame member 54*b* is rotatable either clockwise or counterclockwise, such that an outer surface portion 52 of the member 54*b* remains outwardly-facing.

Frame member 54*b* may be secured in various positions by various means, as will be recognized by one of ordinary skill in the art. For example, frame member 54*b* may be rotated and "clicked" or locked into a closed position with the aid of the combination of a male and female member. A frame member 54*a*, 54*b* in such an embodiment comprises a hemispherical projection which locks into and mates with a female receiving portion on the other member. A ledge or other rotational delimiting is provided to prevent over-rotation of frame member 54*b* and maintain the member 54*b* substantially in the position shown in FIG. 7.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An archery sighting mechanism for interconnection with an archery bow, comprising:

a first sighting pin selectively translatable by a user in at least a vertical direction, the position of the first sighting pin corresponding to a projected or intended distance of an archery projectile when the bow is provided in a predetermined orientation;

a plurality of secondary sighting pins, the plurality of secondary sighting pins being interconnected with the bow;

the first sighting pin and the plurality of secondary sighting pins being selectively positionable with respect to one another such that at least one of the first sighting pin and the plurality of sighting pins are removable from a field of view of a user; and wherein the first sighting pin is interconnected to a first frame member and the plurality of secondary sighting pins are interconnected to a second frame member, said first and second frame members adapted for viewing a downfield target therethrough.

2. The archery sighting mechanism of claim 1, wherein the plurality of secondary sighting pins are removed from the field of view by rotation of the second frame member about a substantially vertical axis.

3. The archery sighting mechanism of claim wherein the plurality of secondary sighting pins are removed from the field of view by rotation of the second frame member about a substantially horizontal axis.

4. The archery sighting mechanism of claim 1, wherein the plurality of secondary sighting pins are removed from the field of view of the first sighting pin by lateral translation of the second frame member.

5. The archery sighting mechanism of claim 1, further comprising at least level-indicia for providing information to a user related to at least one of roll, pitch, and yaw of said archery bow.

6. The archery sighting mechanism of claim 1, wherein each of said plurality of secondary sighting pins correspond to a projected or intended distance of an archery projectile when the bow is provided in a predetermined orientation, and said plurality of sighting pins provided and spaced apart at even increments.

7. The archery sighting mechanism of claim 1, wherein at least one the first sighting pin and the plurality of secondary sighting pins comprise illumination means.

8. A sighting mechanism for interconnection with a bow, comprising:

an adjustable sighting pin, said adjustable sighting pin being translatable in at least one plane;

a plurality of sighting pins, said plurality of sighting pins provided in alignment in a second plane, said second plane being offset from said at least one plane of said adjustable sighting pin;

each of said plurality of sighting pins corresponding to a respective predetermined desired distance of travel of a projectile;

said adjustable sighting pin movable with respect to said plurality of sighting pins, the position of the adjustable sighting pin corresponding to a projected or intended distance of a projectile when the bow is provided in a predetermined orientation; and wherein the adjustable sighting pin is interconnected to a first frame member and the plurality of sighting pins are interconnected to a second frame member, said first and second frame members adapted for viewing a downfield target therethrough.

9. The sighting mechanism of claim 8, wherein the adjustable sighting pin and the plurality of sighting pins being selectively positionable with respect to one another such that at least one of the first sighting pin and the plurality of sighting pins are removable from a field of view of a user.

10. The sighting mechanism of claim 8, wherein the plurality of sighting pins are removed from the field of view by rotation of the second frame member about a substantially vertical axis.

11. The sighting mechanism of claim 8, wherein the plurality of sighting pins are removed from the field of view by rotation of the second frame member about a substantially horizontal axis.

12. The sighting mechanism of claim 8, wherein the plurality of sighting pins are removed from the field of view of the adjustable sighting pin by lateral translation of the second frame member.

13. The sighting mechanism of claim 8, further comprising at least level-indicia for providing information to a user related to at least one of roll, pitch, and yaw of said bow.

14. The sighting mechanism of claim 8, wherein each of said plurality of sighting pins correspond to a projected or intended distance of an archery projectile when the bow is provided in a predetermined orientation, and said plurality of sighting pins provided and spaced apart at even increments.

15. The sighting mechanism of claim 8, wherein at least one the adjustable sighting pin and the plurality of sighting pins comprise illumination means.

16. A method of adjusting an archery sight for a bow, the archery sight comprising a first pin adjustable in a first plane and a plurality of substantially fixed pins provided in a second plane and wherein each of said substantially fixed pins are provided on a single frame portion or fixed member, the method comprising:

determining a corresponding distance of travel of a projectile for at least one of the plurality of substantially fixed pins by targeting an object at a known distance;

based on the determined corresponding distance of travel for the projectile for the at least one substantially fixed pin, selectively adjusting the first pin with respect to the at least one of plurality of substantially fixed pins such that the first pin corresponds to a second distance; and selectively removing the plurality of substantially fixed pins from an archer's line of sight by rotating each of said substantially fixed pins out of a field of view without altering a position of the first pin.

17. The method of claim 16, wherein the plurality of substantially fixed pins are removed from the archer's line of sight by rotation of a frame member comprising the plurality of substantially fixed pins.

18. The method of claim 17, wherein the frame member is rotated about a substantially vertical axis.

* * * * *